US006773548B1

(12) United States Patent
Thibierge et al.

(10) Patent No.: US 6,773,548 B1
(45) Date of Patent: Aug. 10, 2004

(54) PAPER COMPRISING AN EMBOSSED PATTERN, METHOD FOR PRODUCING AND CLOTH FOR MAKING SAME

(75) Inventors: Emeric Thibierge, Asnières (FR); Jean-Francois Loeillot, Colombes (FR)

(73) Assignee: Thibierge et Comar, Paris (FR)

( * ) Notice: Subject to any disclaimer, the term of this patent is extended or adjusted under 35 U.S.C. 154(b) by 0 days.

(21) Appl. No.: 09/529,816

(22) PCT Filed: Oct. 20, 1998

(86) PCT No.: PCT/FR98/02248

§ 371 (c)(1),
(2), (4) Date: Jul. 31, 2000

(87) PCT Pub. No.: WO99/20835

PCT Pub. Date: Apr. 29, 1999

(30) Foreign Application Priority Data

Oct. 20, 1997 (FR) ..... 97 13114

(51) Int. Cl.[7] ..... D21H 17/00

(52) U.S. Cl. ..... 162/109; 162/117; 162/296; 162/321; 162/323; 162/361

(58) Field of Search ..... 162/109, 116, 162/117, 361, 321, 323, 296

(56) References Cited

U.S. PATENT DOCUMENTS

| | | | | | |
|---|---|---|---|---|---|
| 65,730 | A | * | 6/1867 | Day | 162/117 |
| 361,849 | A | * | 4/1887 | Taylor | 162/117 |
| 1,571,715 | A | | 2/1926 | Fearing | |
| 2,890,540 | A | * | 6/1959 | Britt | 162/117 |
| 4,671,983 | A | | 6/1987 | Burt | 428/179 |

FOREIGN PATENT DOCUMENTS

| | | |
|---|---|---|
| EP | 0 458 973 A1 | 12/1991 |
| GB | 2149 827 A | 6/1985 |

* cited by examiner

*Primary Examiner*—Peter Chin
(74) *Attorney, Agent, or Firm*—Westerman, Hattori, Daniels & Adrian LLP

(57) ABSTRACT

The invention concerns a paper comprising a damask embossed pattern (23) on at least one of its surfaces, said pattern (23) being produce by the combination of at least a base (24) and at least an inlaid zone (25), the base in the inlaid zone having differently oriented and shaped wools. The invention further concerns a method for making said paper and cloth for implementing the method. The invention is particularly applicable to printing and/or writing paper.

10 Claims, 3 Drawing Sheets

PAPER COMPRISING AN EMBOSSED PATTERN, METHOD FOR PRODUCING AND CLOTH FOR MAKING SAME

The present invention concerns a paper having an embossed pattern on one of its faces. This pattern is made up of the combination of at least one ground and one inlaid area, the wefts of the ground and of the inlaid area having different slants and shapes so as to give the effect seen on damask fabrics.

Damask fabrics are made up of a ground which has a weft slanting one way and an area inlaid in that ground which has a particular shape and a weft slanting in a different way from that of the ground. The wefts may be such that they make an embossed pattern with dots or an embossed pattern with dashes. The dots may be distributed in a particular grain and the dashes may have particular slants and lengths. Many variants of such damask fabrics are available on the market providing an almost unlimited choice of patterns.

The invention therefore aims at supplying a new paper which comprises an embossed pattern having the appearance of a damask fabric Papers are known which have grains. These papers of the prior art have grains which are more or less round and are spread evenly over the surface of the paper. This kind of grained paper does not give a damask effect at all. The papers are made on a paper making machine in a traditional manner, then the paper is embossed by means of a graining felt or a graining roller, so that indentations are created on the surface of the paper. The graining felt is wrapped on one of the wet presses. The graining roller is put at the end of the machine or off the paper machine and embosses a finished paper.

Also, papers are known which are made on a cylinder paper machine. These papers are generally of better quality than papers made on a Foudrinier machine and generally have a higher grammage. The cylinder machine includes a pick-up felt, which is placed at the exit of the bath of cellulosic fibers and is designed to pick up the sheet of cellulosic fibers being formed and to carry it to the rollers compressing the sheet to extract the water from it.

In summary, known grained papers made by the prior art are papers with grains spread evenly over the surface.

The invention aims at supplying a paper, made on a Foudrinier machine or a cylinder machine, which has an embossed pattern on at least one of its sides. This pattern is made up of the combination of at least one ground and one inlaid area, in which the wefts of the ground and the inlaid have different slants and shapes, so as to produce an effect of the type of the effect which can be seen on damask fabrics.

Such a paper with a damask effect is new and to the knowledge of its inventors has never before been manufactured or offered for sale.

The invention also aims at providing a process for making such a paper with a damask effect.

The invention also aims at providing means for implementing the process for making a paper with a damask effect.

In the first place, a more specific explanation of what is meant by a paper with a damask effect follows.

The damask fabric shown in these Figures is not part of the invention, but helps to understand the aim at which the invention is directed.

Figure 1:
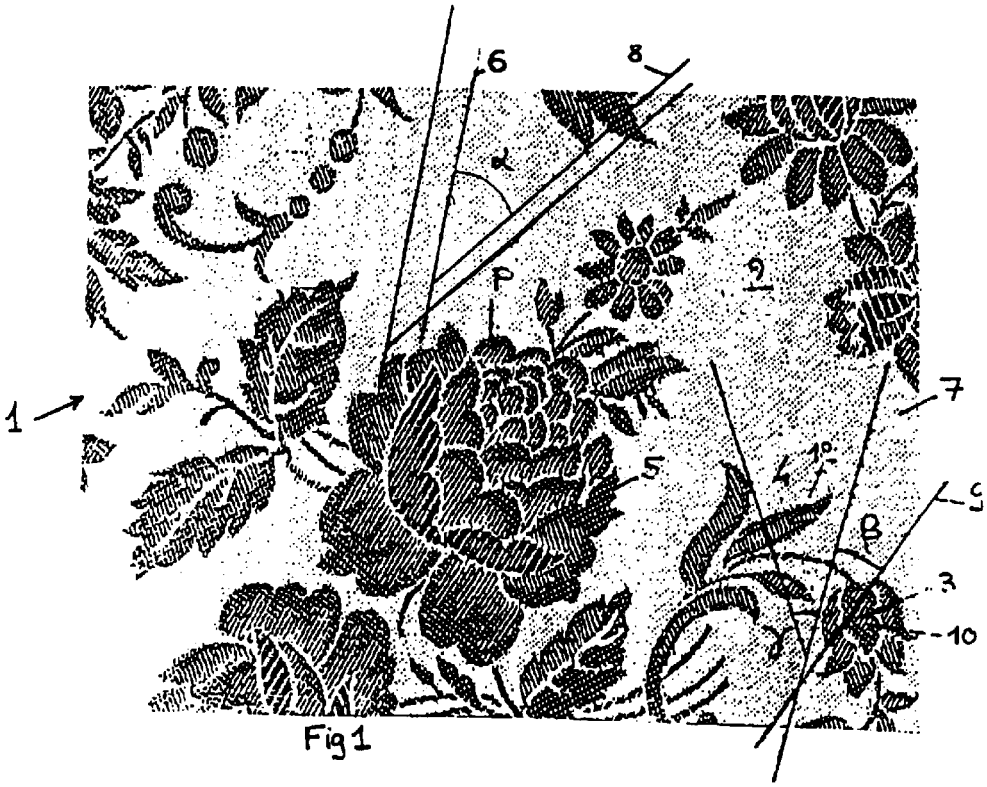
FIG. 1 shows a damask fabric with a pattern.

In FIG. 1, it can be seen that fabric 1 has patterns formed by ground 2 and areas 3, 4 and 5 inlaid in ground 2. Ground 2 is such that it has parallel rows 6 of dots 7 which are equidistant one from another and rows 8 of dots 7, the rows 6 forming an angle a with the rows 8. Dots 7 are more particularly short dashes formed by the threads of the weft passing over the threads in the warp. Areas 3, 4, 5 have various, different contours. Areas 3, 4, 5 are inlaid in ground 2. The term "inlaid area" used in the present description and in the claims means an area lying in the ground, with a particular shape at its contour P, and with its upper surface in the same plane as the upper surface of ground 2. The term "upper surface" means the surface adjacent to the upper part of the weft threads. Indeed, the weft threads lie above the warp threads on the right side of the fabric, and are therefore in a plane above the plane of the warp threads. An embossed shape is therefore formed by the weft threads. Area 3 has parallel rows 9 of dashes 10 forming an angle $\beta$ with the rows 6 of dots 7 in ground 2. Angle $\beta$ is different from angle a. Likewise, zone 4 has parallel rows 11 of dashes 12 forming an angle $\gamma$ with the rows 6 of dots 7 in ground 2. Angles $\alpha$, $\beta$ and $\gamma$ are different one from another. The dashes 10, 12 are formed by the weft threads which pass over several warp threads. We see therefore that the fabric is made up of a ground 2 comprising dots spread evenly over the surface, these dots being aligned in rows, and of one or several inlaid areas comprising dashes aligned in parallel rows, the rows of the dots of ground 2 lying in a different direction from the rows of dashes in the inlaid areas, and the inlaid areas having different contours P. Moreover, the dots and dashes are raised in relation to the general plane of ground 2.

Figure 2:
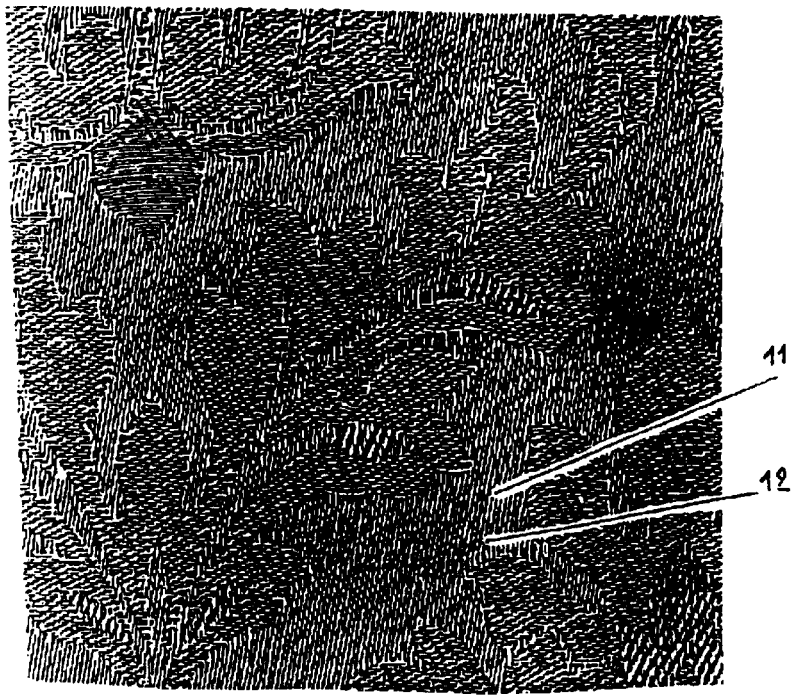
FIG. 2 shows a damask fabric with another pattern.

FIG. 2 shows another form of damask fabric which has a ground 11 comprising dashes 12 and not dots.

Figure 3:
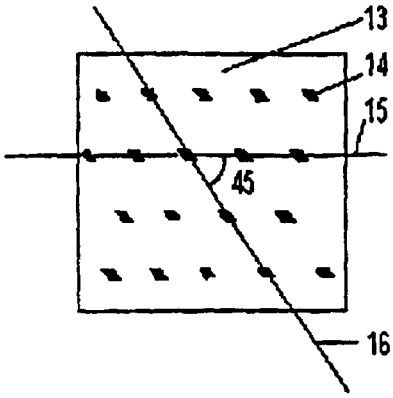
Figure 4:
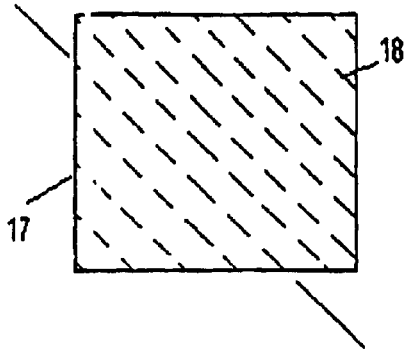

FIG. 3 shows a ground 13 made up of dots 14 which are aligned in rows 15 and rows 16, the angle a between rows 15 and 16 being 45°. In FIG. 4 we have shown a ground 17 made up of dashes 18. In a fabric, the dots 14 and dashes 18 are formed by the weft threads of the fabric. That is why the term "weft" will be used hereinafter to refer to the dots and dashes of a pattern on a paper, by analogy with the fabrics.

Figure 5:
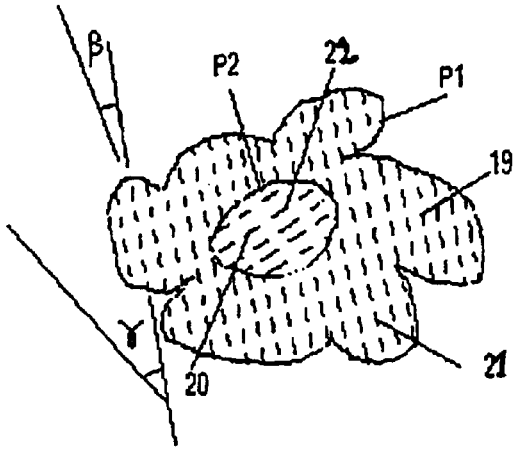

FIG. 5 shows an inlaid area 19 which has a contour P1 and an inlaid area 20 which has a contour P2. The contours P1 and P2 have different shapes. The inlaid area 19 comprises rows of dashes 21 which form an angle p with the rows of dots 14 in the ground 13 and an angle $\gamma$ with the rows of dashes 18 in the ground 17. Likewise, area 20 has rows of dashes 22 which have a different slant from the rows of dots 14 in the ground 13 and the rows of dots 18 in the ground 17. It will be understood that if it is desired to achieve a damask effect, areas 19 and 20 must be inlaid, or inset or inserted in ground 13 or 17, in such a way that the upper surface of the inlaid area is on the same level as the upper level of the ground. A different visual effect will be obtained by inlaying areas 19 and 20 in ground 13 or in ground 17.

The paper according to the invention comprises such a damask pattern.

The paper according to the invention is therefore a paper characterized in that it comprises an embossed pattern on at least one of its faces, the said pattern being made by the combination of at least one ground and at least one inlaid area, with the wefts of at least one of the grounds and at least one of the inlaid areas having different slants and shapes.

According to one embodiment of the invention, the ground does not have a weft whereas at least two areas have wefts with different slants and shapes.

According to another embodiment of the invention, the ground has dots aligned in a first series of parallel rows and in a second series of parallel rows, the first series forming a given angle a with the second series.

According to yet another embodiment of the invention, the ground comprises a series of parallel rows of dashes.

According to another embodiment of the invention, the inlaid areas each have series of parallel rows of dashes, the series of dashes in one area slanting in relation to the series of dashes in another area.

The paper according to the, invention is preferably a paper with grammage above 100 gsm, preferably above 160 gsm.

The paper according to the invention may also be inked to accentuate the embossed shape of at least one of the inlaid areas.

The present invention also aims at providing a process for making the above-mentioned paper.

According to a first embodiment of the process of the invention, the pattern is made on paper made on a cylinder paper machine. In this case, the embossed pattern is made by putting the imprint of a special cloth on the surface of the sheet of paper. To avoid the overly mechanical appearance of blind embossing, and to make the embossed shape as high as possible, the imprint should preferably be made earlier in the process of making the sheet, at a stage when it is most able to take an imprint because of its high water content which makes it very suitable for molding. The special cloth may thus be placed directly on the cylinder, or replace the pickup felt, or replace a felt in wet presses or a combination of several of these techniques may be used, especially if it is desired to obtain an effect on both sides of the paper.

The invention also concerns a cloth to be used in the process according to the invention.

Such a cloth is a woven wire having a pattern, said pattern being made by the combination of at least one ground and at least one inlaid area, the ground and the inlaid area having wefts with different slants and shapes.

According to one embodiment of the invention, the cloth is woven in a single piece comprising the ground and at least one inlaid area, or the cloth is made up of a ground with a weft having a certain slant, in which one or several cut-outs have been made in which one or several areas have been inserted, the weft of these areas having a different slant from the weft in the ground.

In the second case, the areas may be assembled by stitching the contours of the areas, welding or gluing the edges or by any other process suitable for attaching the inlaid area or areas.

According to a second embodiment of the invention, the pattern is applied to paper made on a Foudrinier machine. In this case, the embossed pattern may be imprinted by means of a sort of roller which takes up the entire width of the machine. According to another embodiment, the pattern can be made outside the machine. The paper can be given a background grain by means of a felt and inlaid areas can be added by means of a roller or a graining roller. The pressure applied on the graining roller to make the inlaid areas is heavy, so that the grain left by the felt in the location of the inlaid areas does not have its original ground weft but has the weft of the inlaid areas.

The paper according to the invention can also be made on a cylinder machine by giving it a grain by a traditional means and by adding the pattern by means of a roller or graining roller. Embodiment of the process of the invention may be used for a paper made on a Foudrinier machine.

The invention also concerns a woven cloth having a pattern, said pattern being made by the combination of at least one ground and at least one inlaid area, the ground and the inlaid area having wefts with different slants and shapes.

The cloth may be made of metal or synthetic material.

The following description, along with the accompanying which are provided as non exhaustive examples, will help understand how the invention can be put into practice.

FIG. 1 is a view of a damask fabric with a pattern.

FIG. 2 is a view of another damask fabric with a different pattern from the fabric in FIG. 1.

FIG. 3 is a diagrammatic view of a ground.

FIG. 4 is a diagrammatic view of a ground which is different from the ground in FIG. 3.

FIG. 5 is a view of an inlaid area, which is shown alone, without a ground.

Figure 6:
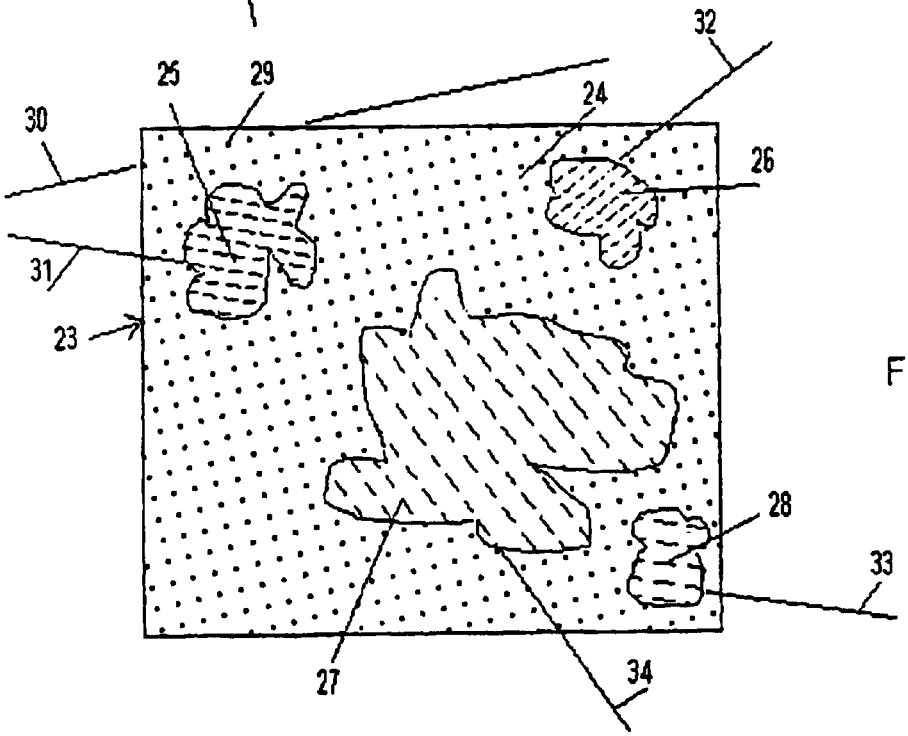

FIG. 6 is a diagrammatic view of a pattern according to the invention transferred to a paper.

Figure 7:
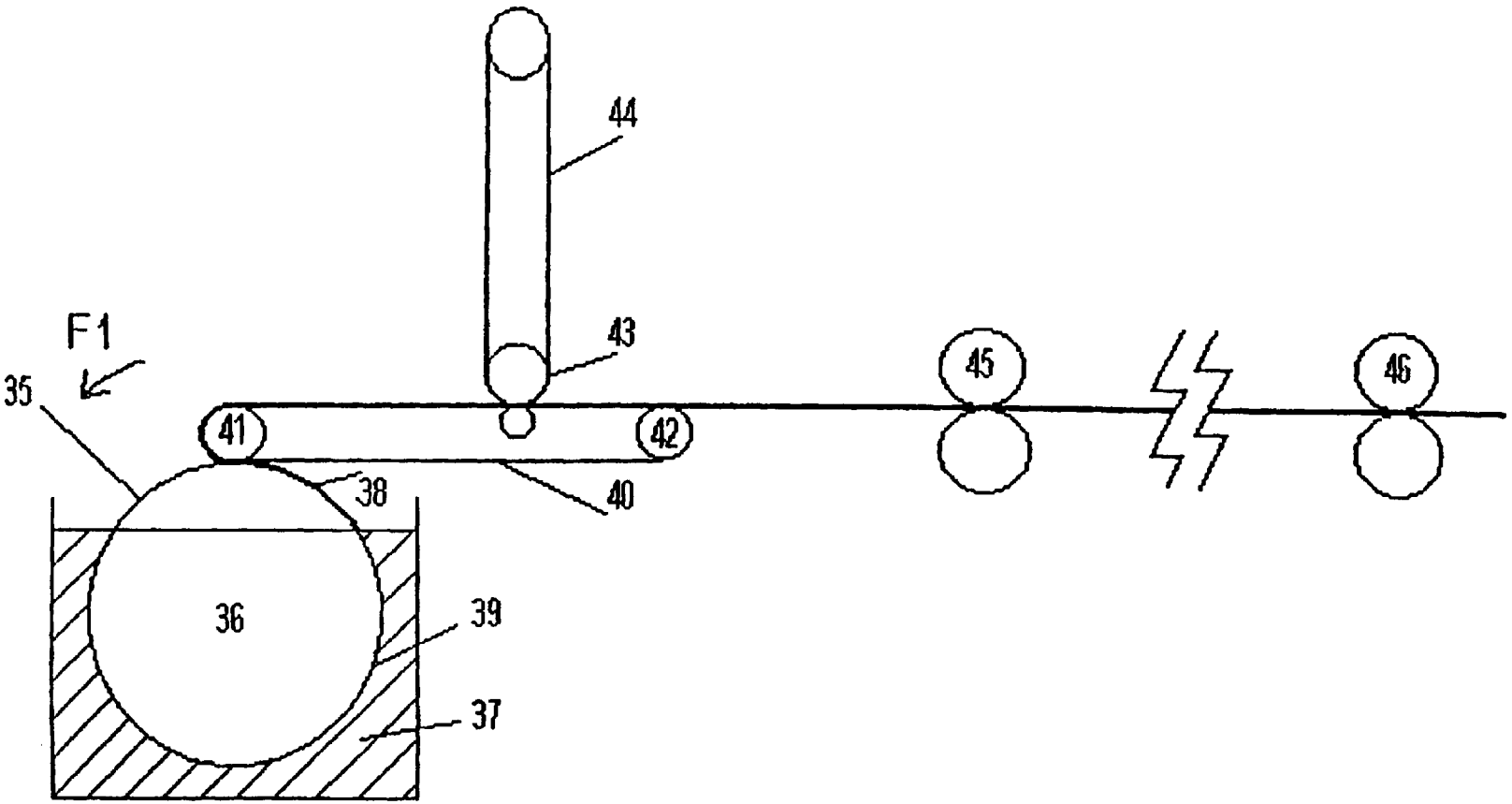

FIG. 7 is a diagrammatic view of a cylinder machine fitted with various means according to the invention for making the paper according to the invention.

FIGS. 1, 2, 3, 4 and 5 have already been explained above in relation to damask fabric. But, according to the invention, the patterns represented on these figures are patterns transferred to the paper according to the invention.

It is seen in particular on FIG. 6, in a diagrammatic form, a paper having a pattern giving a damask effect. This pattern is made up of a ground 24 and several inlaid areas 25, 26, 27 and 28.

According to a very important characteristic of the invention, the pattern is an embossed pattern on at least one of the sides of the paper. The ground 24 comprises, for example, dots 29 aligned in parallel rows which are called wefts, in reference to woven fabrics. These dots are made according to the process of this invention and they are indented or raised in relation to the surface of the sheet of paper, according to the embodiment of the process of the invention used. The ground may also have dashes, like those shown in FIG. 4, these dashes being in rows or wefts. Like the dots, the dashes are recessed or raised in relation to the surface of the sheet of paper depending on the process used. The wefts 30 on ground 24 have a particular slant.

We see that the inlaid areas 25, 26, 27 and 28 have contours of a different shape one from another. Moreover, areas 25, 26, 27 and 28 comprise rows 31, 32, 33 and 34, respectively, of dashes. The rows or wefts 31, 32, 33 and 34 have slants which are different from the waft 30 of the ground and different one from another.

In FIG. 7 is shown a cylinder paper machine fitted with the means for making the paper according to the invention. In a known manner, the machine has a cylinder 35 which turns on its axis 36 in the direction of Arrow F1. The cylinder dips in an aqueous suspension 37 of cellulosic fibers containing other components usually used in paper making, like charges, binders, etc. A wet sheet 38 of cellulosic fibers is formed as it leaves the cylinder and in the traditional manner is picked up by a pickup felt. Then the sheet is carried between pressing rollers (not shown) to remove the water and finally, it is dried on drying rollers (not shown).

The process according to the invention consists, according to one embodiment, in placing a cloth 39 directly on the cylinder 35. According to the invention, the shaping cloth has an embossed pattern made by the combination of two or several wefts with different slants and shapes.

Another embodiment of the invention consists in replacing the pick-up felt with a pickup cloth 40. This cloth 40 turns around the two rollers 41, 42 in a closed loop. The cloth has an embossed pattern made by the combination of two or several wefts with different slants and shapes.

At 43 are represented presses which allow the wet sheet to be pressed to remove the water. According to another method of making the invention, the top felt 44 of the wet presses is replaced by the cloth described above.

In another embodiment of the invention, the cloth can replace a lower felt.

At 45 is represented a roller which has a pattern. This roller has the same width as the sheet and makes a pattern on the sheet which has already been grained across the whole surface by a traditional process.

The pattern according to the invention can also be made by means of a graining roller 46 which makes a pattern on the sheet which has already been grained by one of the previously described techniques.

A paper can also be made on a Foudrinier machine and the pattern can be made by means of a roller or a graining roller.

The paper according to the invention can be used among other purposes as a printing and/or writing paper, it may be colored in the pulp and/or it may be coated after the pattern has been made according to the invention. If the patterns are made with a graining roller, this roller may be inked and the paper printed simultaneously to accentuate perception of the embossed pattern.

What is claimed is:

1. Process for making a paper having a pattern embossed on at least one side, said pattern being constituted by the combination of a ground and at least one inlaid area, the ground and at least one of the inlaid areas having wefts with different slants and shapes, by means of a vat paper machine comprising a cylinder, a pick-up felt and a wet press having a top felt, said process comprising the following steps:

a wet sheet of cellulose fibers comprising water is former by means of said cylinder, the wet sheet is picked up by the pick-up felt and is carried between said wet press to remove the water and, the sheet of cellulose fibers is dried, wherein the embossed pattern is formed on said sheet before it is dried by applying thereon a cloth that is placed directly in place of the pick-up felt, said cloth being metallic or made of plastic material, and said cloth being woven and comprising a pattern, said pattern being constituted by a combination of a ground and a least one inlaid area, the ground of the inlaid area having wefts with different slants and shapes.

2. A vat paper machine according to claim 1, wherein the cloth comprises a pattern constituted by a combination of a ground, at least one first inlaid area, and at least one second inlaid area inside the first inlaid area, the ground, the first inlaid area, and the second inlaid area having wefts with different slants and shapes.

3. A vat machine comprising a cylinder, connected to a pick-up felt and followed by a wet press, wherein a woven cloth is in place of the pick-up felt, said woven cloth comprising a pattern constituted by the combination of at least one ground and at least one inlaid area, said ground and said inlaid area having wefts with different slants and shapes, said woven cloth being made of a metallic or plastic material.

4. A vat paper machine according to claim 3, wherein said cloth is woven in a single piece comprising the grounds, and at least one inlaid area.

5. A vat paper machine according to claim 3, wherein said woven cloth is constituted by a ground having a weft with a certain slant, in which one or several areas have been cut out and replaced by one or several inlaid areas, with a weft slanting in a different direction from that of the ground, the areas being assembled by stitching, welding or gluing at the contour of the areas or by any other process suitable for attaching the inlaid area or areas.

6. A vat paper machine according to claim 3, wherein the cloth comprises a pattern constituted by a combination of a ground, at least one first inlaid area, and at least one second inlaid area inside the first inlaid area, the ground, the first inlaid area, and the second inlaid area having wefts with different slants and shapes.

7. A paper machine comprising a pick-up felt, wherein the traditional pick-up felt is replaced by a woven cloth, said woven cloth comprising a pattern constituted by the combination of at least one ground and at least one inlaid area, said ground and said inlaid area having wefts with different slants and shapes, said woven cloth being made of a metallic or plastic material.

8. A paper machine according to claim 7, wherein said cloth is woven in a single piece comprising the grounds, and at least one inlaid area.

9. A paper machine according to claim 7, wherein said woven cloth is constituted by a ground having a weft with a certain slant, in which one or several areas have been cut out and replaced by one or several inlaid areas, with a weft slanting in a different direction from that of the ground, the areas being assembled by stitching, welding or gluing at the contour of the areas or by any other process suitable for attaching the inlaid area or areas.

10. A paper machine according to claim 7, wherein the cloth comprises a pattern constituted by a combination of a ground, at least one first inlaid area, and at least one second inlaid area inside the first inlaid area, the ground, the first inlaid area, and the second inlaid area having wefts with different slants and shapes.

* * * * *